United States Patent [19]

Fein

[11] Patent Number: 4,877,997

[45] Date of Patent: Oct. 31, 1989

[54] HIGH BRIGHTNESS AND VIEWED GAS DISCHARGE LAMP

[75] Inventor: Michael E. Fein, Mountain View, Calif.

[73] Assignee: Tencor Instruments, Mountain View, Calif.

[21] Appl. No.: 157,731

[22] Filed: Feb. 18, 1988

[51] Int. Cl.[4] ..... H01J 61/30; H01J 61/52

[52] U.S. Cl. ..... 313/634; 313/22; 313/36; 313/231.71; 313/573; 313/609; 220/2.1 R

[58] Field of Search ..... 313/634, 231.71, 573, 313/612, 36, 44, 22, 609, 619, 610; 220/2.1 R; 372/55, 61

[56] References Cited

U.S. PATENT DOCUMENTS

| | | | |
|---|---|---|---|
| 1,965,752 | 7/1934 | Schroter et al. | 313/607 X |
| 2,123,709 | 7/1938 | Bristow et al | 313/634 X |
| 2,258,765 | 10/1941 | James | 313/573 X |
| 2,763,806 | 9/1956 | Anderson, Jr. | 313/185 |
| 2,915,665 | 12/1959 | Vulmiere et al. | 313/113 |
| 3,271,612 | 9/1966 | Keller | 313/634 X |
| 3,778,661 | 12/1973 | Gedanken et al. | 313/634 X |
| 3,928,786 | 12/1975 | Campbell | 313/493 |
| 4,002,922 | 1/1977 | Young | 307/88.3 |
| 4,012,214 | 3/1977 | Furuse et al. | 65/34 |
| 4,208,618 | 6/1980 | Heine | 315/324 |
| 4,210,876 | 7/1980 | Ogata | 331/94 |
| 4,213,100 | 7/1980 | Keijser et al. | 331/94.5 |
| 4,325,006 | 4/1982 | Morton | 315/112 |
| 4,524,301 | 6/1985 | Cohen et al. | 313/493 |
| 4,635,272 | 1/1987 | Kamide et al. | 372/87 |
| 4,810,924 | 3/1989 | Jelic | 313/609 |

FOREIGN PATENT DOCUMENTS

| | | | |
|---|---|---|---|
| 2457815 | 6/1976 | Fed. Rep. of Germany | 313/36 |

*Primary Examiner*—Donald J. Yusko
*Assistant Examiner*—Michael Horabik
*Attorney, Agent, or Firm*—Thomas Schneck

[57] ABSTRACT

An end-viewed low-pressure gas discharge lamp and an envelope for said lamp having a capillary tube discharge bore for containing an excitable gas in which the capillary tube is in direct contact with a cooling medium. A window of optical quality fused silica, a thin section of bubble and particle free glass blown quality silica or sapphire is disposed on an end of the capillary tube for emitting light from a discharge of the excitable gas. A pair of electrodes are hermetically sealed through the envelope for producing a discharge in the capillary tube between the electrodes. The envelope may include a return path parallel to the capillary tube or a side tube as a means for connecting the two ends of the capillary tubes with the electrodes without obstructing the end view of the discharge. Filling the envelope with an excitable mixture of one or more gases, such as vaporized mercury, to a less than atmospheric pressure, and connecting the electrodes to a power supply completes the lamp. Cooling of the capillary tube may be with air or with water in a jacket surrounding the envelope.

22 Claims, 3 Drawing Sheets

HIGH BRIGHTNESS AND VIEWED GAS DISCHARGE LAMP

TECHNICAL FIELD

The present invention relates to gas discharge lamps and in particular to envelope structures for end-viewed capillary lamps for achieving a bright output.

BACKGROUND ART

Low-pressure mercurcy lamps are used as light sources in many optical systems. Some applications only use light coming from a small emission region of a lamp and only within a narrow range of angles about a viewing axis. For example, a microspectroreflectometer may typically use light within a 0.8° half-angle cone radiating from a 100 μm square region on the lamp. In such cases, there is little concern regarding the total optical power or radiant flux emitted by the lamp, but only about the power emitted into this limited acceptance region, i.e. the "brightness" of the lamp. it may also be important to maximize the brightness of a particular spectral line or of a narrow range of wavelengths of emitted light, rather than the brightness over the entire spectrum of light emitted by the lamp. In the case of low-pressure mercury lamps used in microspectroreflectometers and similar applications, the 253.7 nm mercury line is usually the wavelength of particular concern.

In U.S. Pat. No. 2,763,806, Anderson describes an end-viewed discharge tube surrounded by a separate fused envelope. The mercury discharge passes from one electrode in the discharge tube through the tube and returns through the annular region between the outside of the discharge tube and the inside of the envelope to another electrode in the annular region. Electrodes are hermetically sealed through the non-viewing end of the envelope. Compared to a conventional Penray lamp, made of drawn double-bore capillary tubes, in which the discharge is viewed from the side, an end-viewed lamp such as Anderson's with a 1 mm capillary bore discharge tube is about four times brighter, each lamp operating at a current that optimizes its brightness.

It is known from published literature that for the large-bore discharge tubes used in common fluorescent lamps, the mercury discharge is brightest when operating in a temperature range of 10°–50° C. In U.S. Pat. No. 4,325,006, Morton describes a low-pressure Xenon flash lamp which is viewed from the side. The lamp has an annular discharge volume between inner and outer tubes so that coolant may flow through the center as well as outside of the outer tube.

It is an object of the present invention to produce an envelope structure for a discharge lamp which gives a brighter light output.

DISCLOSURE OF THE INVENTION

The above object has been met with an envelope for an end-viewed low pressure discharge lamp having a capillary discharge bore in which the outside of the physical wall which contains the active discharge is directly exposed to a cooling medium. The envelope includes one-viewed capillary tube for containing an excitable low pressure gas, an end window through which light emitted by the discharge may be viewed, and a pair of electrodes between which a discharge passes. The electrodes are positioned in a non-aligned manner so that a gas discharge will follow a bent or curved path, such as a U-shaped path, and therefore the electrodes will not obstruct the view of the discharge through the end window. The wall of the capillary tube is exposed to a cooling medium such as air or water. A jacket may be provided for circulating fluid around the outside of the envelope. The envelope may include electrode volumes for containing the electrodes, both electrodes being hermetically sealed through the enelope. The envelope also includes a return path for the discharge from the capillary tube. The return path is a tube or bore with a free end joined to an end of the capillary bore without an electrode obstructing the end view of the discharge. The return path and the electrode volumes may also function as gas reservoirs for non-depleted gas. Filling the envelope with a low pressure gas and connecting the electrodes to a power supply completes the lamp.

BEST MODE FOR CARRYING OUT THE INVENTION

Figure 1:
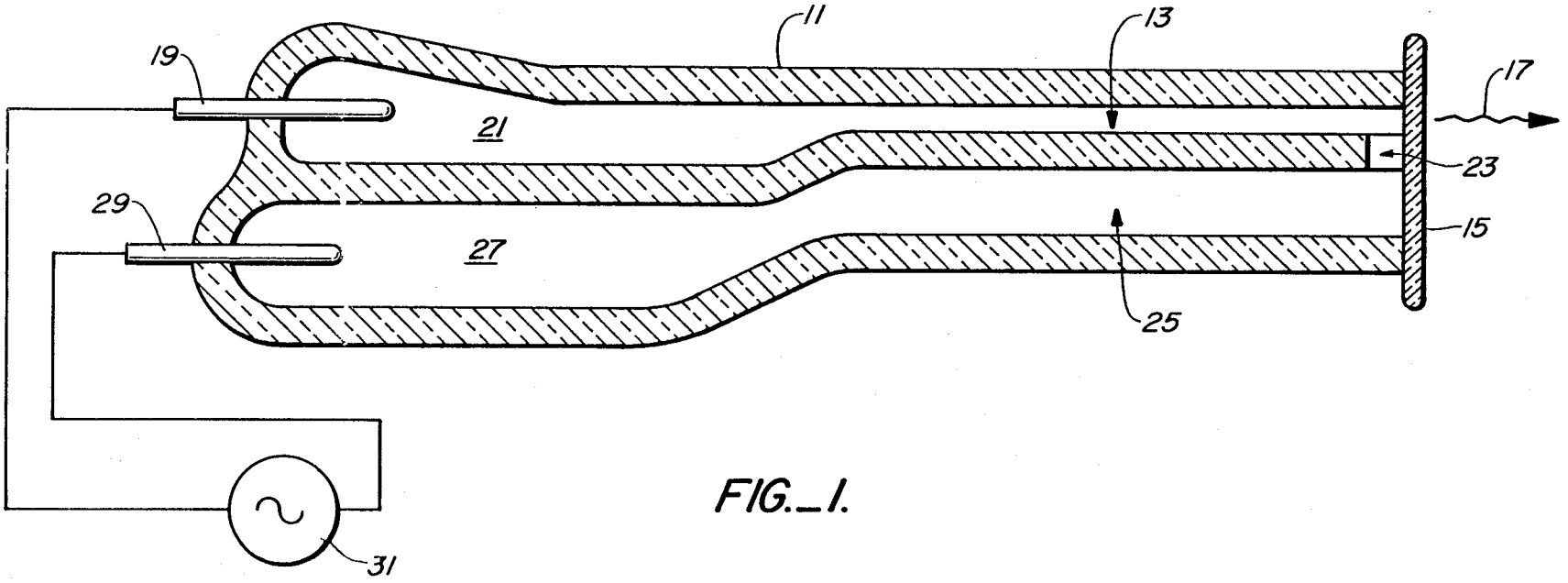
FIG. 1 is a side sectional view cut lengthwise through an end-viewed gas discharge lamp of the present invention.

With reference to FIG. 1, a gas discharge lamp comprises an envelope 11 filled with an electrically excitable gas. Typically, envelope 11 is filled to a low pressure, i.e. to less than atmospheric pressure. The actual gas filling pressure will vary for the different envelope geometries described herein, and for the different gas mixtures with which the envelope 11 may be filled. However, for any given envelope and gas mixture the optimum pressure can easily be determined experimentally with techniques known in the art. A typical optimum filling pressure for a gas mixture of mercury vapor and a buffer gas is estimated to be in a range on the order of 100 torr or less. The gas mixture is composed of one or more gases, at least one of which is electrically excitable to produce a light-emitting discharge. One gas mixture that may be used is vaporized mercury with an argon buffer. Suitable means for optimizing the mixture for maximum brightness at a particular wavelength of interest or within a range of wavelengths are known in the art.

The envelope 11 in FIG. 1 includes a small bore capillary tube 13 for supporting a main discharge of the excitable gas, and window 15 disposed on an end of othe tube 13 for allowing incoherent light 17 from the discharge to be emitted from the end of end-viewing. Envelope material may include electrically insulative glasses, such as fused silica, or ceramics, such as alumina and beryllia. "Small bore" means that tube 13 has a bore diameter not exceeding about 2 mm. It has been determined experimentally for bore diameters down to about 0.5 mm that the smaller the bore diameter, the brighter the light output 17, when gas filling and operating current are optimized for each diameter. Bore diameters for capillary tube 13 can range from 0.1 mm to 2.0 mm. Window 15 is typically a single piece of optical quality fused silica, although other materials can also be used.

Window 15 must be substantially transparent to the wavelength or range of wavelengths of light 17 which are of particular interest. For example, fused silica is transmissive for the 254 nm light of mercury lamps.

Capillary tube 13 enlarges at its nonviewing end, i.e. the end opposite window 15, to form an electrode volume 21 containing an electrode 19. A cross-channel 23 adjacent to window 15 connects the main discharge bore 13 with a return bore 25. Envelope 11 may be formed from a single mass in which capillary and return bores are formed or from two separate tubes which are subsequently joined. Return bore 25 typically has a larger diameter than the bore of capillary tube 13 and is typically larger than 2 mm diameter. Making bore 25 larger than bore 13 has the advanatage of reducing starting and operating voltages below those which would be needed with equal-bore lamps. However, as seen in the embodiment in FIG. 2, return bore 25 can also have the same diameter as the bore of capillary tube 13, but should not be smaller. Returning now to FIG. 1, with capillary tube 13 bore diameters in the range of 0.1 mm - 2.0 mm and return bore 25 larger in diameter than 2.0 mm, there is viewed discharge only in capillary tube 13. The discharge in return bore 25 is of lower intensity, and is not viewed. Return bore 25 enlarges at the end opposite window 15 into an electrode volume 27 containing an electrode 29. Electrodes 19 and 29 are hermetically sealed through envelope 11 so as to contain the gas fill without leaking while connecting the electrode volumes 21 and 27 electrically to an interior power supply 31. Electrode lead-ins or supports sealed to the envelope may also be provided. Power supply can be either an AC or DC supply. The power supply voltage and current are selected experimentally to optimize brightness of the lamp output. A typically optimum current is on the order of 30 milliamps.

Envelope 11 is air-cooled, the surface of bore 13 containing the main discharge being in contact with air outside of envelope 11. Cooling is by free convection, the external air being substantially still but with some thermal currents forming due to the temperature difference between the air and the hot envelope. Alternatively, the air can be force circulated for even greater cooling. In any case, the temperature of the discharge is maintained within a desired temperature range. The optimum temperataure varies for each gas mixture and can easily be determined experimentally by known techniques. For mercury, a typical optimum operating temperature range is estimated to be approximately 10°-50° C.

Figure 2:
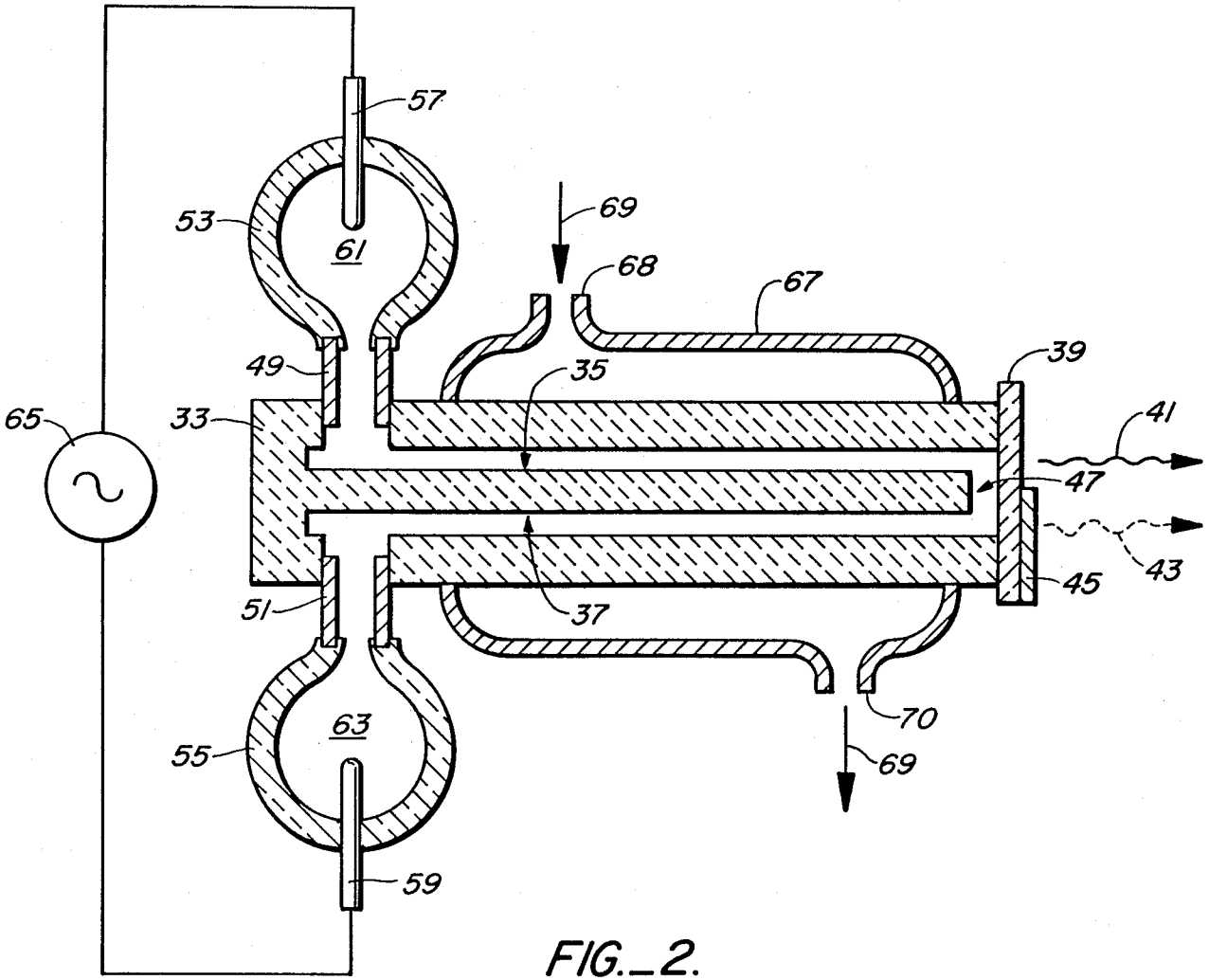
FIG. 2 is a side sectional view of a second gas discharge lamp of the present invention.

With reference to FIG. 2, an envelope 33 has first and second capillary bores 35 and 37 for containing an excitable gas. Envelopes may be composed of electrically insulative glasses or ceramics, such as fused silica or other blow glass, as in FIG. 1, or alumina, beryllia (both polycrystalline ceramics) or form-grown sapphire (a monocrystalline material), as in FIG. 2. A window 39 on one end of envelope 33 allows light 41 from the discharge in bore 35 to be emitted from that end. Alternatively, light 43 from the discharge in bore 37 may be viewed. Generally, only light 41 or 43 from one discharge is used, the other being locked by an opaque stop 45 on or near window 39. This allows the user to select the light passing through that portion of window 39 having fewer defects, such as bubbles or dust, for better output characteristics. Alternatively, some applications could utilize both beams. Window 39 is typically a monocrystalline sapphire window frit-sealed to the envelope 33.

A cross-channel 47 at the window end of envelope 3 connects discharge bores 35 and 37. Cross-channel 47 has transverse dimensions equal to or larger than those of bores 35 and 37. A pair of tubes 49 and 51, of Kovar or other controlled expansion alloy, are brazed to envelope 33 at an end opposite from window 39, and connect discharge bores 35 and 37 to electode bottles 53 and 55. Bottles 53 and 55 are typically glass, flame-sealed to Kovar tubes 49 and 51. Kovar is a tradename for an alloy or iron, nickel and cobalt having a coefficient of expansion practically identical to many glasses and ceramics and forming a good seal with glass. Electrodes 57 and 59 are hermetically sealed through bottles 53 and 55 so as to contain the gas fill without leakage while electrically connecting electrode volmes 61 and 63 in bottles 53 and 55 to an electric power supply 65. Again, power supply 65 may provide either DC or AC power.

The lamp in FIG. 2 is water-cooled. A water jacket 67 surrounds the outside circumference of envelope 33, allowing water or some other liquid coolant to make contact with the envelope walls adjacent to bores 35 and 37. Cooling is by forced convection as water 69 is pumped through inlet 68, and then out through outlet 70 at a rate sufficient to maintain the wall within a range of temperatures for optimum brightness, such as approximately 10° to 50° C. for a mercury lamp emitting principally 254 nm lilght. Jacket 67 is typically a Kovar jacket brazed to envelope 33.

Figure 3:
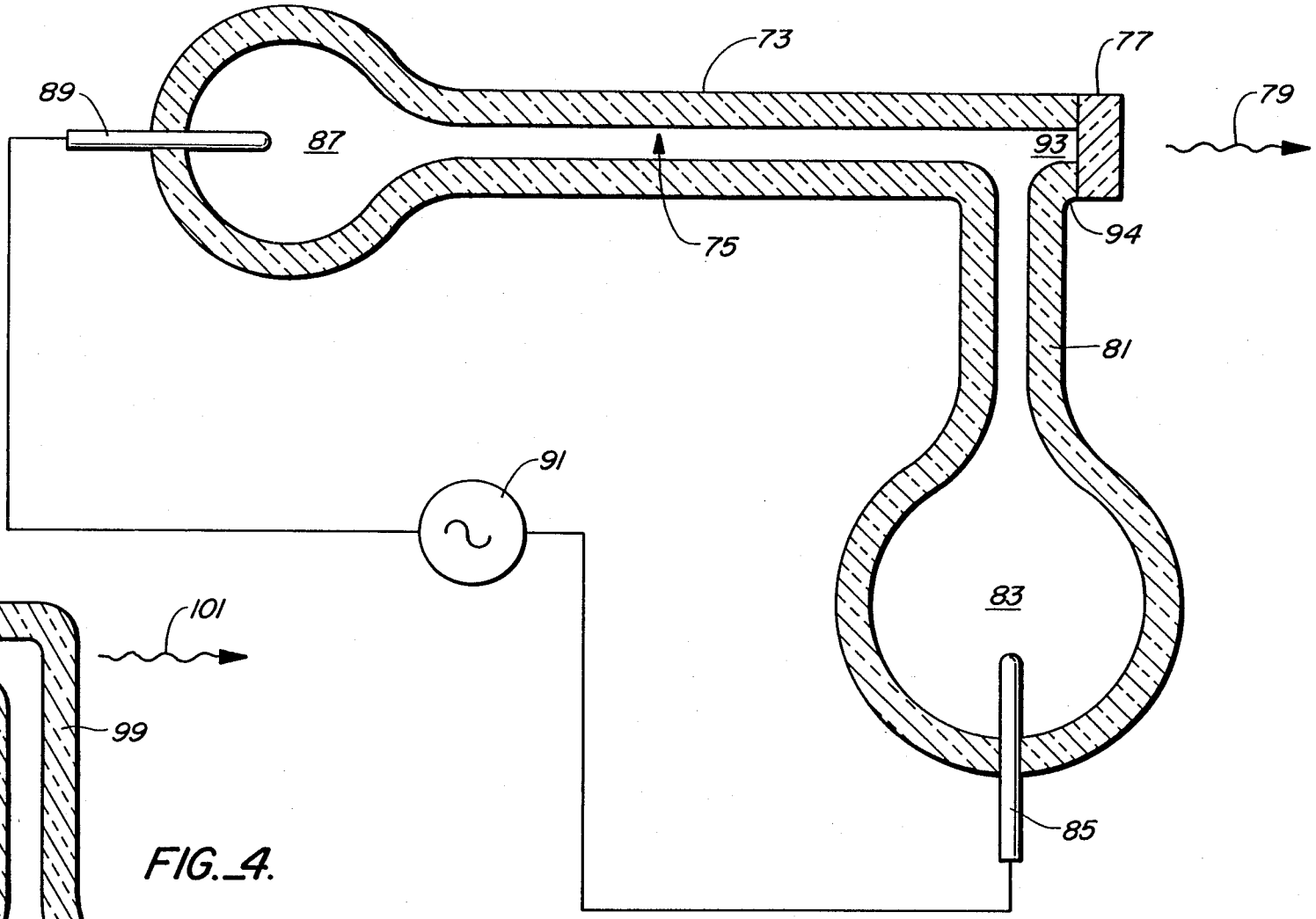
FIG. 3 is a side sectional view of a third gas discharge lamp of the present invention.

With reference to FIG. 3, an envelope 73 includes a capillary tube bore 75 for containing excitable gas. A discharge in bore 75 emits light 79 through an end window 77. Envelope 73 includes a side tube 81 at the window end of bore 75. Side tube 81 expands to form an electrode volume 83 containing an electrode 85 hermetically sealed through the envelope. Side tube 81 enables electrode 85 to be placed proximate to the window end of bore 75 without obstructing the view of the discharge through window 77. The non-viewing end of discharge bore 75 opposite window 77 also enlarges to form an electrode volume 87 containing an electrode 89 hermetically sealed through envelope 73. When envelope 73 is filled with a low pressure gas and electrodes 85 and 89 are connected to a power supply 91, an electric gas discharge is formed between electrodes 85 and 89, extending alongn bore 75 and side tube 81. As with all of the other embodiments described above, the active discharge may be either continuously operating or quasi-continuously operating. Quasi-continuous operation means that at each period of discharge, the discharge is on long enough so that discharge conditions reach a steady state. A quasi-continuous output can be achieved, for example, with a repetitively pulsed current of 20 kHz square waves with a duty cycle of approximately 10%.

The lamps described above typically have a length on the order of 5 to 50 mm. It is known in the art how to optimize the length for mazimized brightness. At the optimum length, a shorter main discharge region gives a loss of output, while a longer region results in no further output gain. One millimeter diameter bore mercury lamps have been found to work well at a length on the order of 25 mm, although further optimization is expected to be possible.

The return bores 25 and 37 in FIGS. 1 and 2, and side tube 81 in FIG. 3 both provide a means for connecting the two ends of the main discharge bore 13, 35 and 75 to electrodes without the electrodes obstructing the viewing path. The cross-channel 23 and 47 in the dual bore versions in FIGS. 1 and 2 are preferably placed adjacent to windows 15 and 39 in order to avoid creating an absorptive dead space between the discharge and the window, such as dead space 93 in FIG. 3. Dead space 93 created by the lip 94 is needed to connect window 77 to the envelope 73 in a hermetically sealed fashion. Dead space 93 should be kept as small as possible. Dead space 93 should be kept as small as possible. While dead spaces, i.e. spaces containing gas where no discharge is occurring, are common in some gas discharge tubes, such as gas lasers, where the desired output radiation does not terminate in the ground state, such dead areas would be highly absorptive of resonance radiation terminating in the ground state, as for example the 254 nm emission in mercury lamps. An alternate window end for the lamp in FIG. 3 is seen in FIG. 4.

Figure 4:
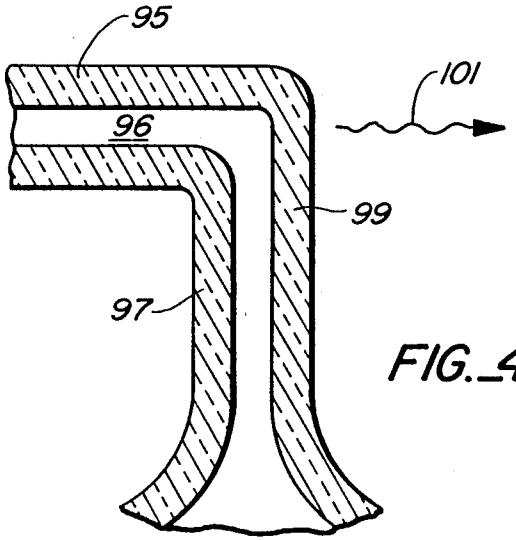
FIG. 4 is a side sectional view of an alternate window portion for the lamp in FIG. 3.

In FIG. 4, a portion 95 of an envelope includes a discharge bore 96. The envelope bends at the viewing end of discharge bore 96 to form a side tube 97 and window 99. Window 99 is thus a unitary part of the envelope and thus may be a relatively thin section of glass blowing quality fused silica, so long as the presence of bubbles and particles in the glass is avoided in the radiation 101 emitting region of the window. Because the entire envelope including window 99 is a unitary structure with an L-shaped bend, absorptive dead spaces like space 93 in FIG. 3 are avoided.

Because the lamps of the present invention have their main capillary discharge tube in direct contact with a cooling medium, they can be operated near their optimum temperature, resulting in brighter outputs. A mercury discharge lamp similar to FIG. 1, with a one millimeter discharge bore has a measured brightness out of the end of the bore which is 50% greater than previous end-viewed capillary lamps, similar to the lamps shown in Anderson, U.S. Pat. No. 2,763,806, with the same bore diameter.

I claim:

1. An end viewed low pressure gas discharge lamp comprising:

an elongated envelope including a small bore capillary tube and a second tube in communication with said capillary tube, said second tube defining a return path parallel to said capillary tube and connecting via a cross channel to said capillary tube, an outside wall of said capillary tube being in direct contact with a cooling medium, an electrically excitable gas in said capillary tube, a substantially planar window disposed on an end of said capillary tube adjacent to said cross channel for observing therethrough light emitted by said excitable gas, and a pair of spaced apart electrode means sealed hermetically through said envelope for producing a discharge through said capillary tube between said pair of electrodes, one of said electrode means being at an end of said capillary tube opposite from said window, the other of said electrode means being in said return path.

2. The lamp of claim 1 wherein said gas includes mercury.

3. The lamp of claim 1 wherein said envelope is composed of material taken from the group consisting of fused silica, glass, alumina, beryllia, and form-grown sapphire.

4. The lamp of claim 1 further comprising a jacket disposed around said envelope for forced convection cooling of said capillary tube with a liquid coolant.

5. An end viewed low pressure gas discharge lamp comprising:

an elongated envelope including a small bore capillary tube and a second tube in communication with said capillary tube, said envelope having an L-shaped bend at an end of said capillary tube, an outside wall of said capillary tube being in direct contact with a cooling medium, an electrically excitable gas in said capillary tube, a substantially planar window disposed on an end of said capillary tube for observing therethrough light emitted by said excitable gas, said window being defined by a portion of said envelope adjacent to said L-shaped bend and opposite said capillary tube, and a pair of spaced apart electrode means sealed hermetically through said envelope for producing a discharge through said capillary tube between said pair of electrodes.

6. An end-viewed low-pressure gas discharge lamp comprising:

a fused silica envelope having a small bore capillary tube for supporting a main discharge of excitable gas and a return tube parallel to said small bore tube, said return tube communicating with said small bore tube via a cross-channel defined near and end of said envelope, said small bore tube being in direct contact with a cooling medium, a transparent substantially planar window disposed on said end of envelope near said cross-channel, a first electrode disposed at an end of said small bore tube opposite from said window, a second electrode disposed in said return tube, said first and second electrodes being hermetically sealed through said envelope and connectable to an electrical power supply for producing a discharge in said small bore tube between said first and second electrodes, and an electrically excitable gas in said envelope for emitting incoherent light from said discharge.

7. The lamp of claim 6 wherein said excitable gas includes mercury.

8. The lamp of claim 6 wherein said window is composed of material selected from the group consisting of fused silica and sapphire.

9. The lamp of claim 6 wherein said small bore tube has a bore diameter in a range from 0.1 to 2.0 mm.

10. The lamp of claim 6 wherein said return tube has a larger bore diameter than said small bore tube.

11. The lamp of claim 6 further comprising a jacket disposed around said envelope for forced convection cooling of said small bore tube with a fluid coolant.

12. An end-viewed low-pressure gas discharge lamp comprising:

an envelope having first and second small diameter capillary bores formed therein, said bores communicating with each other via a cross-channel at an end of said envelope, a substantially planar window disposed on an end of said envelope adjacent said cross-channel, first and second electrodes hermetically sealed through said envelope at ends of said first and second capillary bores opposite from said window, an elecrically excitable gas in said bores, and a jacket surrounding said envelope for forced convection cooling of said capillary bores with a liquid coolant.

13. The lamp of claim 12 wherein said envelope is composed of material selected from the group consisting of alumina, beryllia, and form-grown sapphire.

14. The lamp of claim 12 wherein said gas includes mercury.

15. The lamp of claim 12 further comprising electrode bottles sealed to an end of said respective first and second capillary bores, said electrodes being contained in said bottles.

16. The lamp of claim 12 wherein each of said capillary bores has a bore diameter in a range from 0.1 to 2.0 mm.

17. An end-viewed low-pressure gas discharge lamp comprising:

an L-shaped envelope including an elongated small bore main capillary discharge tube portion and side tube portion, each of said portions having a free end, said portions being connected at said free ends ina bend, a substantially planar transparent window being defiend in said envelope proximate to said bend and opposite said main capillary discharge tube portion, said main capillary discharge tube portion being in direct contact with a cooling medium, a pair of electrodes hermetically sealed in said L-shaped envelope at opposite ends thereof, and an electrically excitable gas in said envelope filled to less than atmospheric pressure.

18. The lamp of claim 17 wherein said wiindow is frit-sealed to said envelope, a dead space being defined between said bend and said window.

19. The lamp of claim 17 wherein said window is a unitary portion of said envelope, said bend being immediately adjacent said window so as to leave no dead space therebetween.

20. The lalmp of claim 17 wherein said gas includes mercury.

21. The lamp of claim 17 wherein said main capillary discharge tube portion has a bore diameter in a range from 0.1 to 2.0 mm.

22. The lamp of claim 17 further comprising a jacket surrounding said envelope for forced convection cooling of said main capillary discharge bore with a liquid coolant.

* * * * *

UNITED STATES PATENT AND TRADEMARK OFFICE

CERTIFICATE OF CORRECTION

PATENT NO. : 4,877,997

DATED : October 31, 1989

INVENTOR(S) : Michael E. Fein

It is certified that error appears in the above-identified patent and that said Letters Patent is hereby corrected as shown below:

On the title page:

ITEM [54] "HIGH BRIGHTNESS AND VIEWED GAS DISCHARGE LAMP" should read - - HIGH BRIGHTNESS END VIEWED GAS DISCHARGE LAMP - -.

Column 1, line 63, "one-viewed" should read - - one end-viewed - -.

Column 2, line 55, "end of othe" should read - - end of the - -.

Column 2, line 57, "of end-viewing." should read - - for end-viewing. - -.

Column 3, line 31, "to an interior" should read - - to an exterior - -.

Column 3, line 56, "other blow glass," should read - - other blown glass - -.

Column 3, line 63, "the other being locked" should read - - the other being blocked - -.

Column 4, line 3, "envelope 3" should read - - envelope 33 - -.

Column 4, line 12, "alloy or iron" should read - - alloy of iron - -.

Column 4, line 48, "alongn" should read - - along - -.

Column 5, lines 10-11, "as small as possible. Dead space 93 should be kept as small as possible. While dead" should read - - as small as possible. While dead - -.

UNITED STATES PATENT AND TRADEMARK OFFICE

CERTIFICATE OF CORRECTION

PATENT NO. : 4,877,997

DATED : October 31, 1989

INVENTOR(S) : Michael E. Fein

It is certified that error appears in the above-identified patent and that said Letters Patent is hereby corrected as shown below:

Claim 6, column 6, line 30, "and end" should read - - an end - -.

Claim 17, column 7, line 21, "ina bend" should read - - in a bend - -.

Claim 20, column 8, line 14, "The lalmp" should read - - The lamp - -.

Signed and Sealed this

Twelfth Day of March, 1991

*Attest:*

*Attesting Officer*

HARRY F. MANBECK, JR.

*Commissioner of Patents and Trademarks*